US009808663B2

(12) United States Patent
Chen

(10) Patent No.: US 9,808,663 B2
(45) Date of Patent: Nov. 7, 2017

(54) MULTIFUNCTIONAL KINETIC MECHANISM

(71) Applicant: JOONG CHENN INDUSTRY CO., LTD., Nantou, Nantou County (TW)

(72) Inventor: James Chen, Nantou (TW)

(73) Assignee: JOONG CHENN INDUSTRY CO., LTD., Nantou, Nantou County (TW)

( * ) Notice: Subject to any disclaimer, the term of this patent is extended or adjusted under 35 U.S.C. 154(b) by 0 days.

(21) Appl. No.: 15/213,895

(22) Filed: Jul. 19, 2016

(65) Prior Publication Data

US 2017/0087402 A1 Mar. 30, 2017

(30) Foreign Application Priority Data

Sep. 30, 2015 (TW) ..... 104215712 U

(51) Int. Cl.
*A63B 21/06* (2006.01)
*A63B 21/062* (2006.01)
(Continued)

(52) U.S. Cl.
CPC ..... *A63B 21/0626* (2015.10); *A63B 21/0615* (2013.01); *A63B 21/08* (2013.01);
(Continued)

(58) Field of Classification Search
CPC ..... A63B 21/00058; A63B 21/00061; A63B 21/00065; A63B 21/00069;
(Continued)

(56) References Cited

U.S. PATENT DOCUMENTS 2,932,509 A * 4/1960 Zinkin ..... A63B 21/0615 482/97
3,475,024 A * 10/1969 Lewis ..... A63B 21/0615 482/97

(Continued)

FOREIGN PATENT DOCUMENTS

TW I357342 B 2/2012

OTHER PUBLICATIONS https://web.archive.org/web/20130828001304/http://www.purmotion.net:80/renegade-system.html.*

(Continued)

*Primary Examiner* — Andrew S Lo
*Assistant Examiner* — Gary D Urbiel Goldner
(74) *Attorney, Agent, or Firm* — Muncy, Geissler, Olds & Lowe, P.C.

(57) ABSTRACT

A multifunctional kinetic mechanism includes a base including a slant tube, a counterweight unit including a joint shaft rotatably connected to the slant tube of the base, a barbell shaft having a first end piece connected to the joint shaft and a second end piece opposite to the first end piece and a counterweight attached to the second end piece of the barbell shaft, and an operating unit including a main frame, a sleeve located at a front side of the main frame and sleeved onto the second end piece of the barbell shaft, two grips respectively pivotally mounted at an opposing rear side of the main frame and two shoulder cushion pads mounted at a bottom side of the main frame between the sleeve and the two grips. Thus, a user can operate the operating unit to move the barbell shaft to train different muscle groups.

5 Claims, 9 Drawing Sheets

(51) Int. Cl.
*A63B 21/08* (2006.01)
*A63B 23/035* (2006.01)
*A63B 23/04* (2006.01)
*A63B 23/12* (2006.01)

(52) U.S. Cl.
CPC .. *A63B 23/03516* (2013.01); *A63B 23/03591* (2013.01); *A63B 23/0405* (2013.01); *A63B 23/1209* (2013.01); *A63B 2023/0411* (2013.01)

(58) Field of Classification Search
CPC ..... A63B 21/00072; A63B 21/0615; A63B 21/0616; A63B 21/0617; A63B 21/062; A63B 21/0622; A63B 21/0624; A63B 21/0626; A63B 21/0628; A63B 21/063; A63B 21/0632; A63B 21/065; A63B 21/068; A63B 21/072; A63B 21/0722; A63B 21/0728; A63B 21/075; A63B 21/08; A63B 21/15; A63B 21/159; A63B 21/16; A63B 21/4001; A63B 21/4005; A63B 21/4017; A63B 21/4019; A63B 21/4023; A63B 21/4025; A63B 21/4027; A63B 21/4029; A63B 21/4031; A63B 21/4033; A63B 21/4035; A63B 21/4039; A63B 21/4045; A63B 21/4047; A63B 21/4049; A63B 2023/0411; A63B 23/035; A63B 23/03516; A63B 23/03525; A63B 23/0355; A63B 23/03575; A63B 23/03591; A63B 23/04; A63B 23/0405; A63B 23/047; A63B 23/0482; A63B 23/0494; A63B 23/12; A63B 23/1209; A63B 23/1227; A63B 23/1245; A63B 23/1281; A63B 69/0057; A63B 69/0059; A63B 2208/02; A63B 2208/0204; A63B 2208/0223; A63B 2210/00; A63B 2210/50; A63B 2225/09; A63B 2225/093; A63B 2225/10; A63B 2225/102
See application file for complete search history.

(56) References Cited

U.S. PATENT DOCUMENTS 4,140,315 A * 2/1979 Page, Jr. ..... A63B 21/0615 473/445
4,323,236 A * 4/1982 Szabo ..... A63B 21/0615 482/97
4,344,619 A * 8/1982 Szabo ..... A63B 21/0615 248/161
4,357,010 A * 11/1982 Telle ..... A63B 21/00072 482/113
4,357,011 A * 11/1982 Voris ..... A63B 23/00 482/139
4,657,245 A * 4/1987 Smith ..... A63B 21/0615 482/94
4,863,161 A * 9/1989 Telle ..... A63B 21/00072 482/112
4,865,314 A * 9/1989 Carter, Jr. ..... A63B 21/4005 482/106
5,011,138 A * 4/1991 Rankin ..... A63B 21/072 273/109
5,194,060 A * 3/1993 Marchetti ..... A63B 21/0615 482/133
5,207,624 A * 5/1993 Paskovich ..... A63B 21/072 482/106
5,487,712 A * 1/1996 Kann ..... A63B 21/0615 482/148
5,810,697 A * 9/1998 Joiner ..... A63B 21/06 280/47.371
5,813,951 A * 9/1998 Einsig ..... A63B 21/06 482/1
5,891,003 A * 4/1999 Deac ..... A63B 5/16 482/106
6,280,364 B1 * 8/2001 Deac ..... A63B 5/16 482/106
6,802,800 B1 * 10/2004 Hobson ..... A63B 21/0615 482/137
7,476,183 B1 * 1/2009 Chrest ..... A63B 21/072 482/908
8,177,692 B2 * 5/2012 Deppen ..... A63B 21/0728 434/226
8,974,354 B1 * 3/2015 Nelson ..... A63B 21/08 482/94
9,289,646 B2 * 3/2016 Tully ..... A63B 21/16
2006/0252615 A1 * 11/2006 Melcer ..... A63B 21/078 482/139
2009/0192026 A1 * 7/2009 Mason ..... A63B 21/0615 482/97
2014/0073492 A1 * 3/2014 Hunter ..... A63B 21/0615 482/98
2016/0008653 A1 * 1/2016 Dipasquale ..... A63B 21/0728 482/107

OTHER PUBLICATIONS https://web.archive.org/web/20130416071635/https://www.purmotion.net/wishbone.html.*
https://web.archive.org/web/20130416071531/http://www.purmotion.net:80/renegade-stand.html.*
https://web.archive.org/web/20130213123840/http://purmotion.net:80/renegade-pro.html.*

* cited by examiner

MULTIFUNCTIONAL KINETIC MECHANISM

BACKGROUND OF THE INVENTION

1. Field of the Invention

The present invention relates to exerciser technology and more particularly, to a multifunctional kinetic mechanism.

2. Description of the Related Art

In order to maintain good health and body shape, enhanced leg weight training has great benefits on the support of the upper body. A typical leg exercise, such as squat, is normally trained using a weightlifting rack; however, it should be very careful when using a weightlifting rack to do a lunge or calf-raise exercise.

Due to the factors that outdoor sports require an appropriate venue and are easily be affected by the weather and the factor that people are busy with work and have only limited time to spend for exercise, going to the gym has become a trend.

However, most conventional sports machines simply provide one single mode of operation. If you want to exercise different muscle groups, you must use different functions of sports machines; in consequence, the gym owner will encounter the problems of space crowding and increased costs of purchased equipment.

On the other hand, many people are eager to involve in the sports activity of triathlon, long-distance running or long-distance cycling in recent years, therefore, they attach great importance to the training of the leg muscles, especially the thigh muscles. In order to solve the problem of thigh training, leg squat weightlifting systems are created. For example, Taiwan Patent No. I357342 discloses a weightlifting system that allows the user to make a leg squat operation safely in one machine, enabling the muscle groups of the legs to be effectively trained. However, this design of weightlifting system is complicated in structure, and its operation is dull and boring, and therefore, in practical terms, this design of weightlifting system is not user friendly and there is room for improvement

SUMMARY OF THE INVENTION

The present invention has been accomplished under the circumstances in view. It is the main object of the present invention to provide a multifunctional kinetic mechanism, which has the characteristics of simple structure, ease of operation and multimode operation capability, allowing training of different muscle groups.

To achieve this and other objects of the present invention, a multifunctional kinetic mechanism comprises a base, a counterweight unit, and an operating unit. The base comprises a slant tube. The counterweight unit comprises a joint shaft, a barbell shaft and a counterweight. The joint shaft is detachably connected to the slant tube of the base. The barbell shaft comprises a first end piece and an opposing second end piece. The first end piece is detachably connected to the joint shaft. The counterweight is detachably attached to the second end piece of the barbell shaft. The operating unit comprises a main frame, a sleeve, two opposing grips and two opposing shoulder cushion pads. The sleeve is mounted at the front side of the main frame and detachably sleeved onto the second end piece of the barbell shaft. The two grips are respectively pivotally mounted at the opposing rear side of the main frame. The two shoulder cushion pads are respectively mounted at the bottom side of the main frame between the sleeve and the two grips. Thus, the user can operate the operating unit to exercise different modes of operation, thereby training different muscle groups of the upper and lower limbs.

In one embodiment of the present invention, the joint shaft comprises a first joint member rotatably inserted into the slant tube of the base, and a second joint member vertically pivotally connected to the first joint member. Further, the first end piece of the barbell shaft is plugged into the second joint member. Thus, by means of the joint shaft, the barbell shaft can be operated to swing the counterweight at multiple angles.

In one embodiment of the present invention, the operating unit further comprises two auxiliary handlebars disposed at two opposite sides relative to the sleeve and respectively connected with respective one ends thereof to the bottom side of the main frame for gripping by the user's two hands to maintain operating stability when the two shoulder cushion pads are rested on the user's shoulders and the user is making the action of alternatively standing up and squatting down.

In one embodiment of the present invention, the counterweight unit further comprises an accessory rack disposed around the base. The accessory rack comprising an upright rod, a horizontal bar, and a support bar. After the user finished the operation, the user can rest the barbell shaft on the top end of the support bar, and then detach the operating unit and the counterweight from the barbell shaft, and then respectively attach the operating unit and the counterweight to one upright rods and one horizontal bar, and thus, the component parts storage is done.

Other advantages and features of the present invention will be fully understood by reference to the following specification in conjunction with the accompanying drawings, in which like reference signs denote like components of structure.

DETAILED DESCRIPTION OF THE INVENTION

Figure 1:
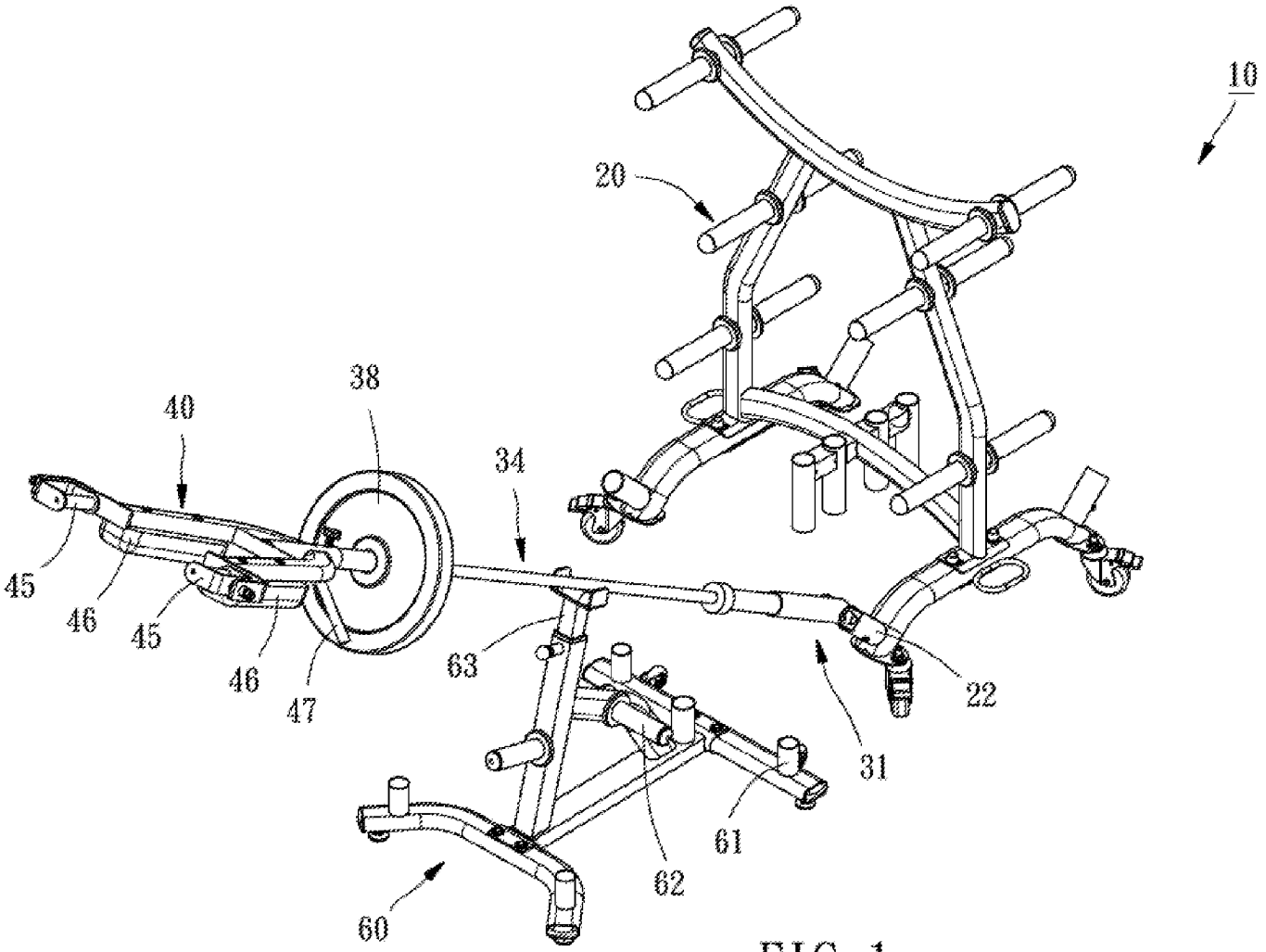
FIG. 1 is an oblique top elevational view of a multifunctional kinetic mechanism in accordance with the present invention.
Figure 2:
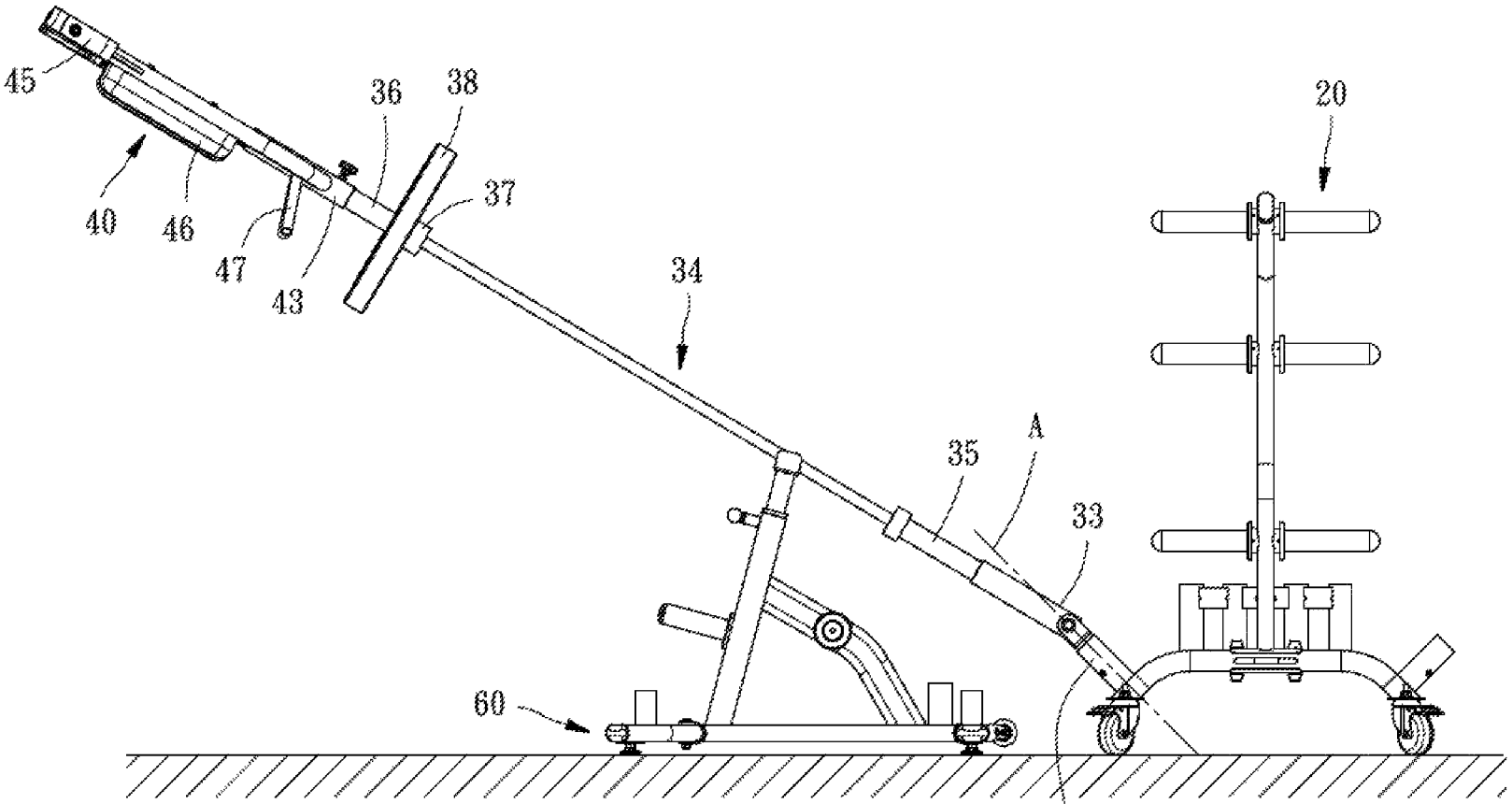
FIG. 2 is a side view of the multifunctional kinetic mechanism in accordance with the present invention.
Figure 3:
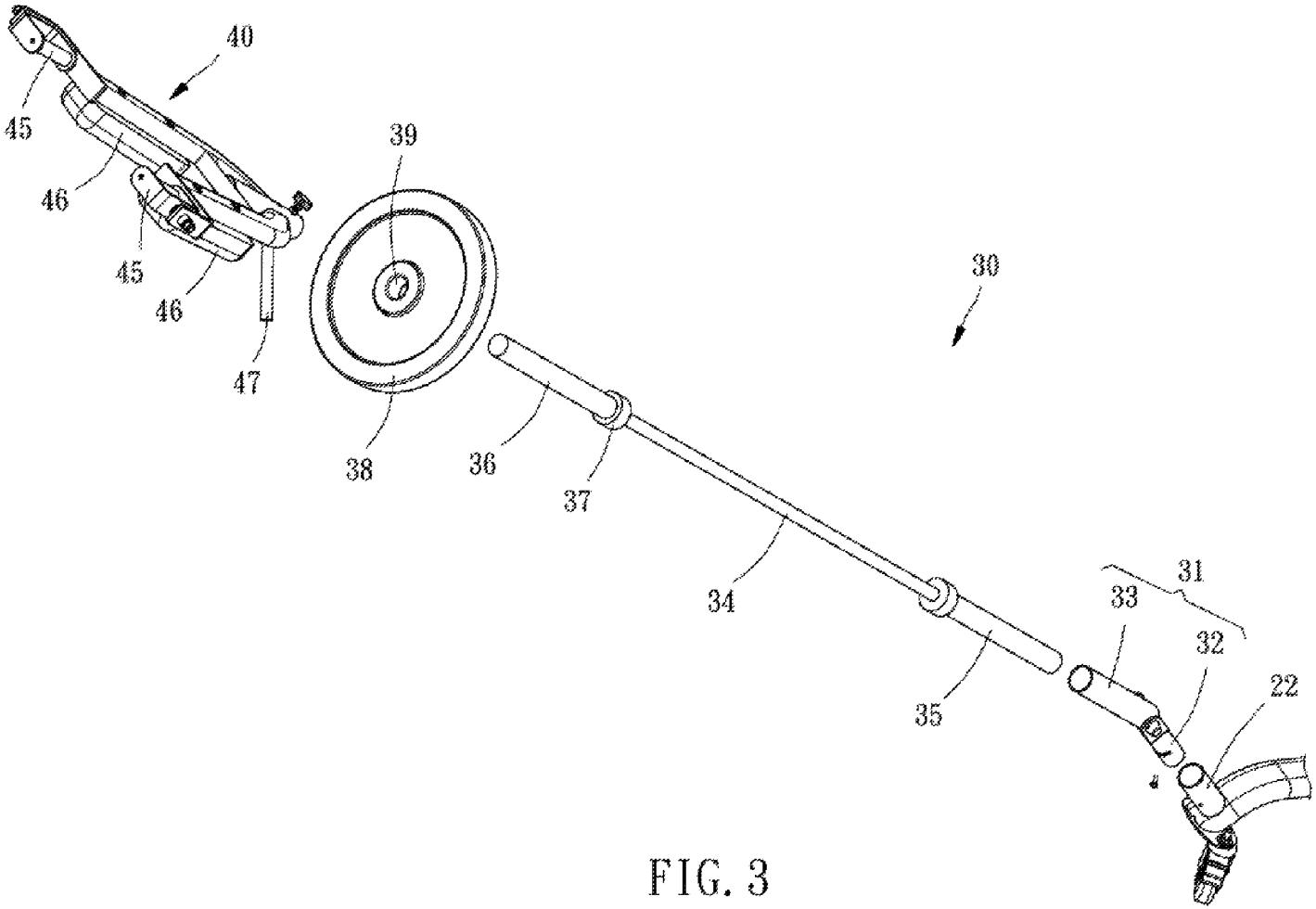
FIG. 3 is an exploded view of a part of the multifunctional kinetic mechanism in accordance with the present invention.

Referring to FIGS. 1-3, a multifunctional kinetic mechanism 10 in accordance with the present invention is shown.

The multifunctional kinetic mechanism 10 comprises a base 20, a counterweight unit 30, and an operating unit 40.

The base 20 is to be placed on the ground as a support. Structurally, the base 20 comprises at least one slant tube 22. The axis of each slant tube 22 defines with the ground a predetermined angle of inclination.

The counterweight unit 30 comprises a joint shaft 31, a barbell shaft 34, and a counterweight 38. The joint shaft 31 comprises a first joint member 32 and a second joint member 33. The first joint member 32 has a bottom end thereof rotatably inserted into one selected slant tube 22 of the base 20, and an opposing top end thereof vertically pivotally connected to a bottom end of the second joint member 33. The barbell shaft 34 comprises a first end piece 35 and an opposing second end piece 36. The barbell shaft 34 is inserted into the second joint member 33 of the joint shaft 31 by the first end piece 35. Thus, by means of the joint shaft 31, the barbell shaft 34 can swing at multiple angles. Further, the second end piece 36 of the barbell shaft 34 comprises a flange 37. The counterweight 38 has a center hole 39. By means of the center hole 39, the counterweight 38 can be attached onto the second end piece 36 of the barbell shaft 34 and stopped at the flange 37.

Figure 4:
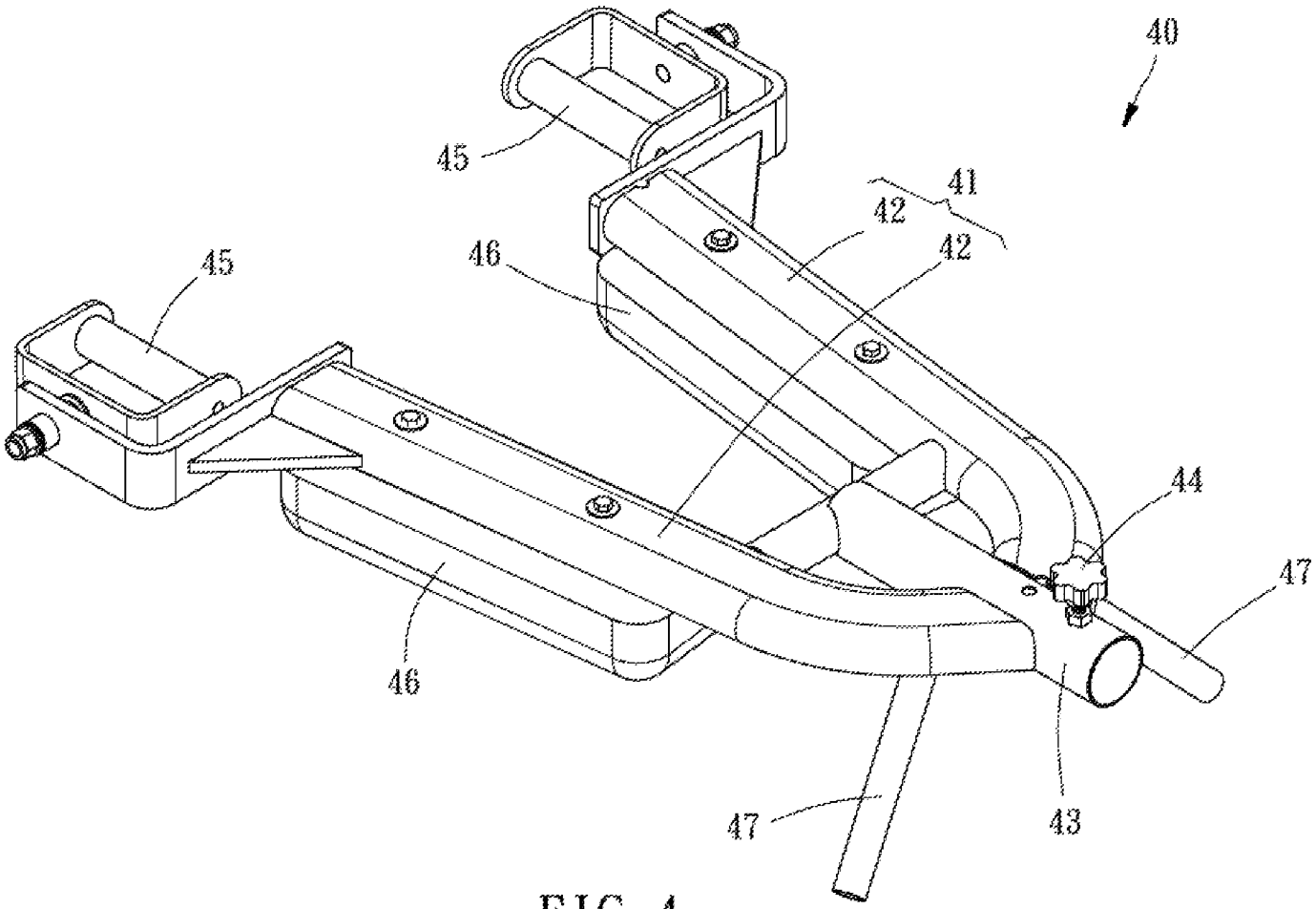
FIG. 4 is an oblique top elevational view of the operating unit of the multifunctional kinetic mechanism in accordance with the present invention.

As illustrated in FIG. 4, the operating unit 40 comprises a main frame 41, a sleeve 43, two opposing grips 45, two opposing shoulder cushion pads 46, and two opposing auxiliary handlebars 47. The main frame 41 is a substantially V-shaped frame comprising two wing bars 42. The sleeve 43 is fixedly connected with respective front ends of the wing bars 42 and sleeved onto the second end piece 36 of the barbell shaft 34, and then locked thereto by a locking member 44 (for example, a finger screw, as shown in FIG. 4). The opposing grips 45 are respectively pivotally mounted at respective opposing rear ends of the wing bars 42 of the main frame 41. The shoulder cushion pads 46 are respectively mounted at respective bottom sides of the wing bars 42 of the main frame 41. The auxiliary handlebars 47 are respectively disposed at opposing left and right sides relative to the sleeve 43, and respectively connected with respective top ends thereof to the bottom sides of the wing bars 42 of the main frame 41.

After understanding the structure details of the multifunctional kinetic mechanism 10, the operation of the multifunctional kinetic mechanism 10 is explained hereinafter.

Figure 5:
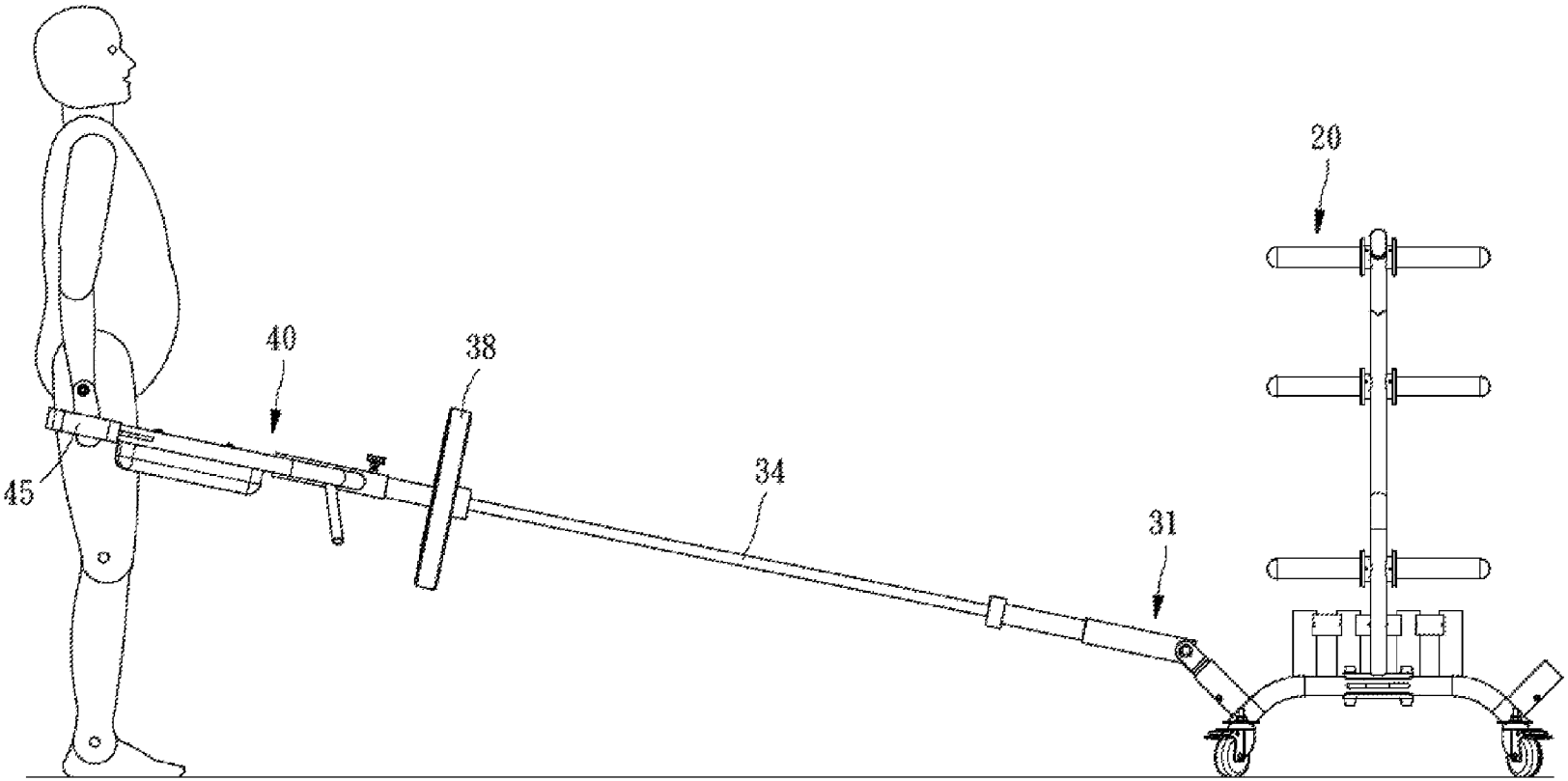
FIG. 5 is a schematic plain view illustrating the operation of the multifunctional kinetic mechanism in the mode of arm lifting (I).
Figure 6:
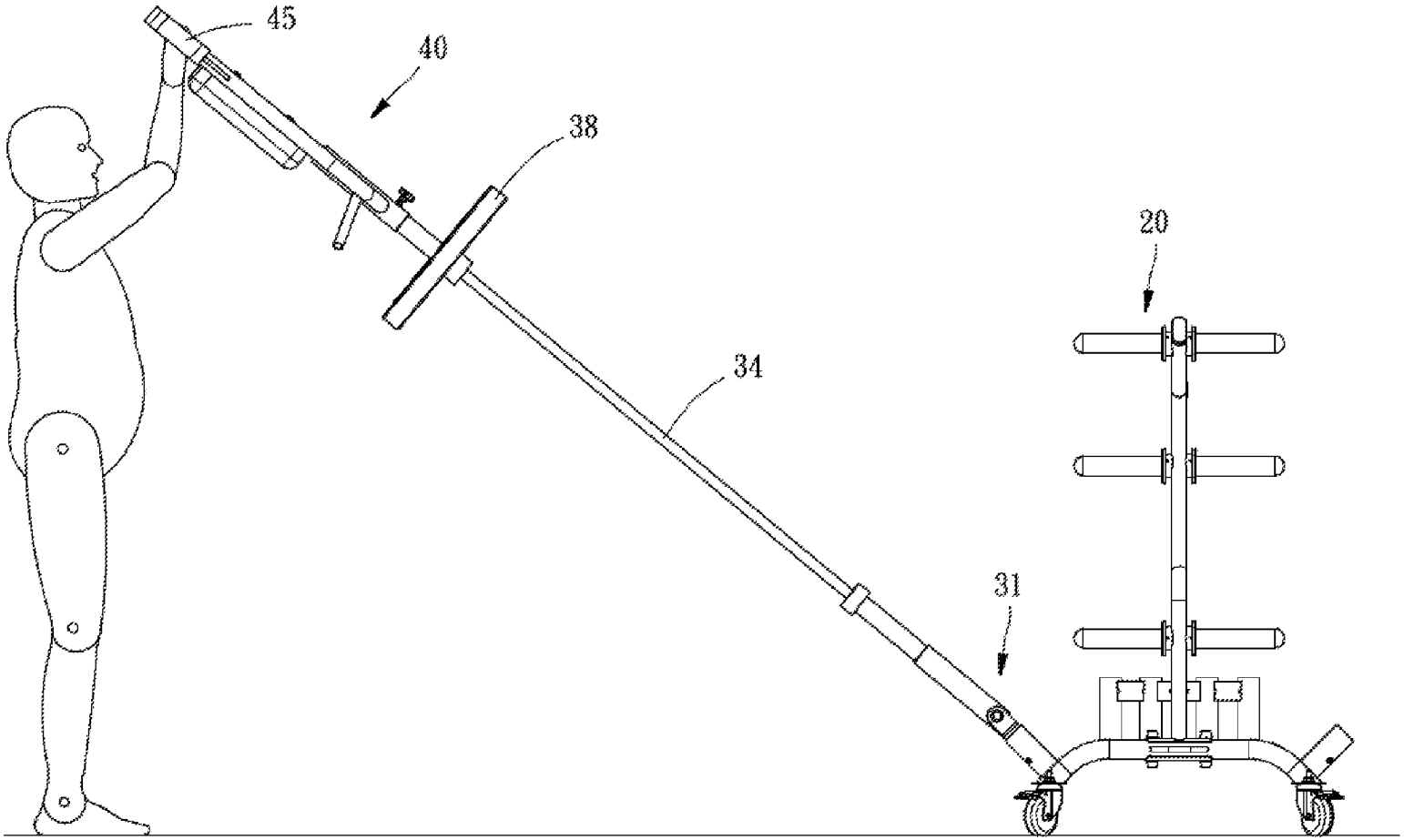
FIG. 6 is a schematic plain view illustrating the operation of the multifunctional kinetic mechanism in the mode of arm lifting (II).

The first mode of operation is to maintain the standing posture facing toward the base 20, and then to hold the grips 45 of the operating unit 40 with the two hands, and then to lift and drop the two hands repeatedly, as shown in FIG. 5 and FIG. 6. When lifting and dropping the hands, the barbell shaft 34 is alternatively biased up and down with the joint shaft 31 relative to the base 20, and at the same time, the counterweight 38 gives a pressure to the arms, enabling the upper limb muscles to be well trained.

Figure 7:
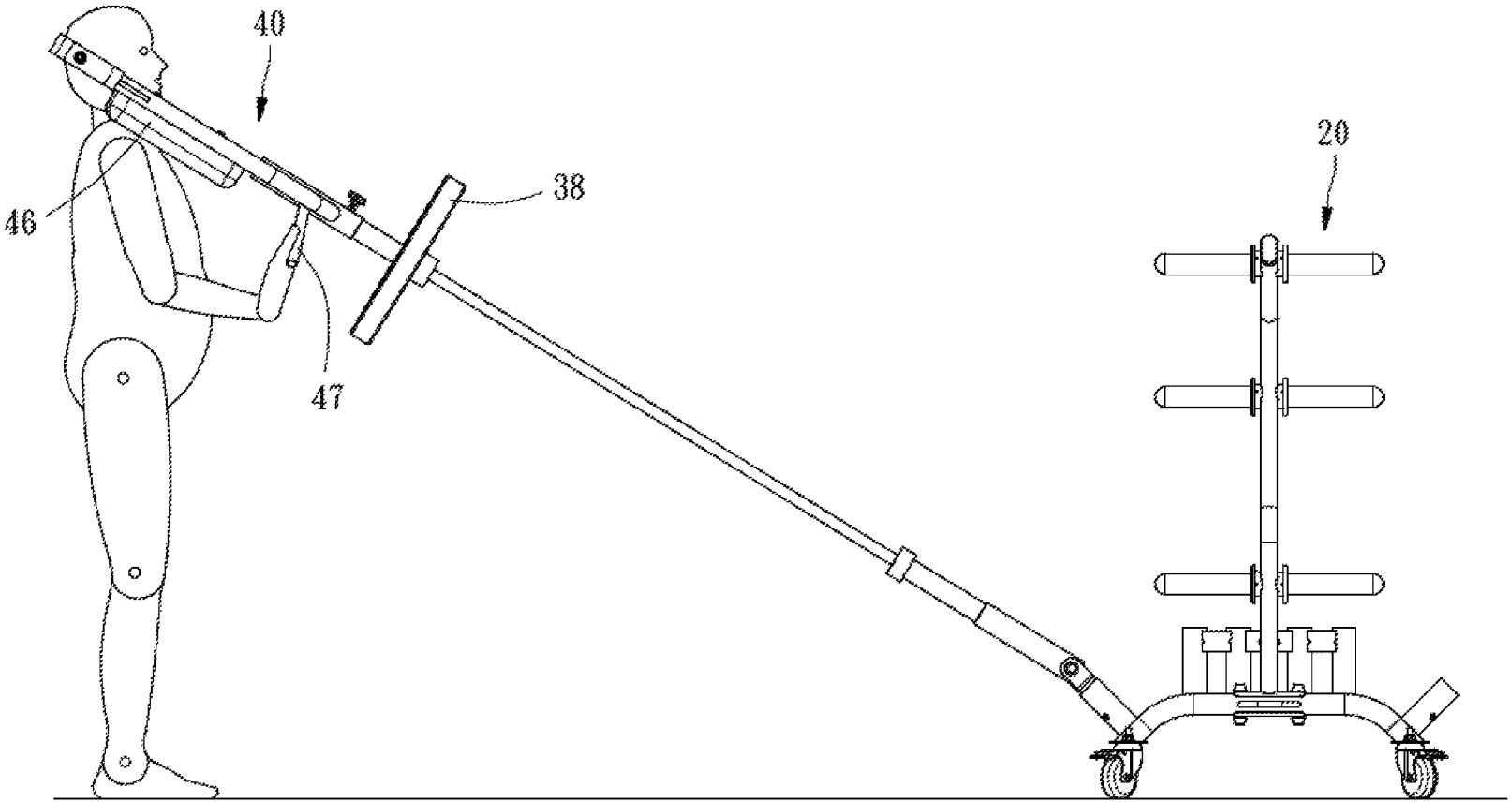
FIG. 7 is a schematic plain view illustrating the operation of the multifunctional kinetic mechanism in the mode of squatting (I).
Figure 8:
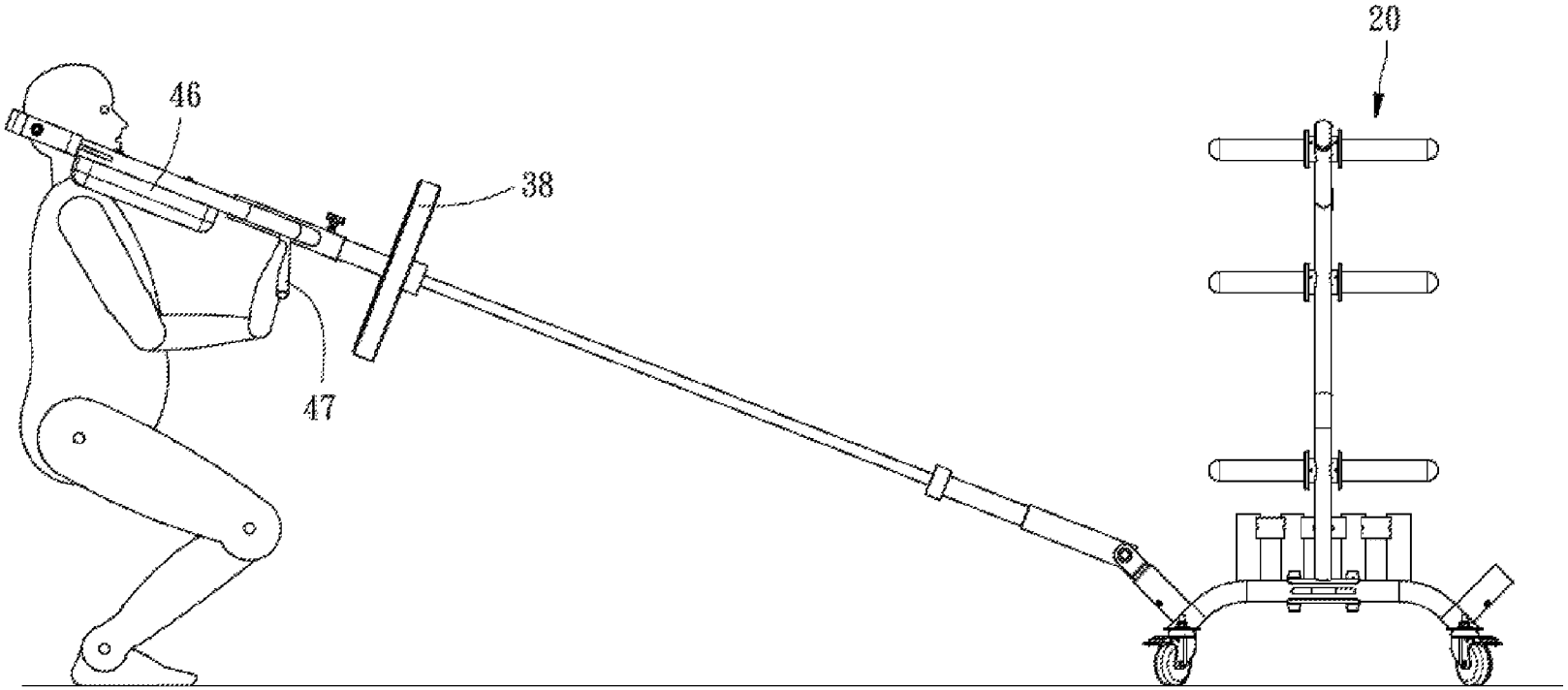
FIG. 8 is a schematic plain view illustrating the operation of the multifunctional kinetic mechanism in the mode of squatting (II).

The second mode of operation is to maintain the standing posture facing toward the base 20, and then to let the shoulder cushion pads 46 of the operating unit 40 be rested on the two shoulders, as shown in FIGS. 7 and 8, and then to repeat the action of alternatively standing up and squatting down. In order to maintain operating stability, the user can hold the auxiliary handlebars 47 with the two hands when making the action of alternatively standing up and squatting down, enabling the lower limb muscles to be well trained subject to the effect of the counterweight 38.

Figure 9:
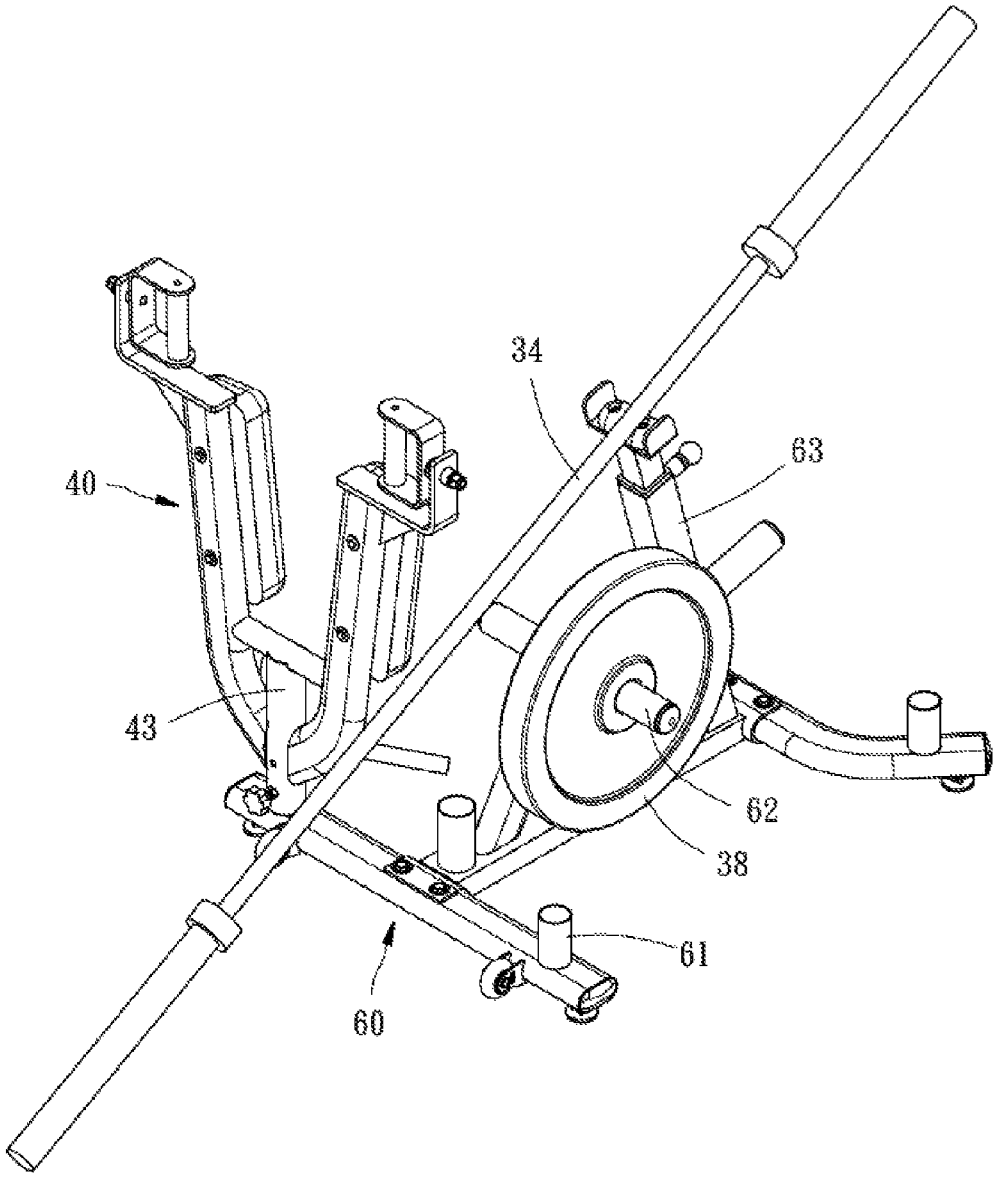
FIG. 9 is an oblique top elevational view of a part of the multifunctional kinetic mechanism in accordance with the present invention, illustrating the operating unit, the barbell shaft and the counterweight received in the accessory rack.

Further, in order to facilitate storage, the counterweight unit 30 of the multifunctional kinetic mechanism 10 further provides an accessory rack 60, as shown in FIGS. 1 and 9. The accessory rack 60 is placed around the base 20. Structurally, the accessory rack 60 comprises a plurality of upright rods 61 (actually, one single upright rod is enough), a plurality of horizontal bar 62 (actually, one single horizontal bar is enough), and one support bar 63. After the user finished the operation, the user can rest the barbell shaft 34 on the top end of the support bar 63, and then detach the operating unit 40 and the counterweight 38 from the barbell shaft 34, and then respectively attach the operating unit 40 and the counterweight 38 to one upright rods 61 and one horizontal bar 62, and thus, the component parts storage is done.

When compared to conventional sports equipment, the multifunctional kinetic mechanism 10 of the present invention has the advantages of simple structure, ease of operation and multimode operation capability, allowing the user to train different muscle groups according to personal needs.

What is claimed is:

1. A multifunctional kinetic mechanism, comprising:

a base comprising a slant tube coupled to the base at a fixed acute angle relative to a horizontal support surface upon which the base is configured to be positioned;

a counterweight unit comprising a joint shaft pivotable about a horizontal axis, a barbell shaft and a counterweight, said joint shaft being detachably connected to said slant tube of said base, said barbell shaft comprising a first end piece and an opposing second end piece, said first end piece being detachably connected to said joint shaft, said counterweight being detachably attached to said second end piece of said barbell shaft; and an operating unit comprising a main frame, a sleeve, two opposing grips and two opposing shoulder cushion pads, said sleeve being mounted at a front side of said main frame and detachably sleeved onto said second end piece of said barbell shaft, said two grips being respectively pivotally mounted at an opposing rear side of said main frame, said two shoulder cushion pads being respectively mounted at a bottom side of said main frame between said sleeve and said two grips.

2. The multifunctional kinetic mechanism as claimed in claim 1, wherein said joint shaft comprises a first joint member rotatably inserted into said slant tube of said base, and a second joint member vertically pivotally connected to said first joint member; said first end piece of said barbell shaft is plugged into said second joint member.

3. The multifunctional kinetic mechanism as claimed in claim 1, wherein said second end piece of said barbell shaft comprises a flange; said counterweight is attached onto said second end piece of said barbell shaft and stopped at said flange.

4. The multifunctional kinetic mechanism as claimed in claim 1, wherein said operating unit further comprises two auxiliary handlebars disposed at two opposite sides relative to said sleeve and respectively connected with respective one ends thereof to the said bottom side of said main frame.

5. The multifunctional kinetic mechanism as claimed in claim 1, wherein said counterweight unit further comprises an accessory rack disposed around said base, said accessory rack comprising an upright rod for supporting said operating unit, a horizontal bar for supporting said counterweight, and a support bar for supporting said barbell shaft.

* * * * *